US006779580B2

(12) United States Patent
Woodward et al.

(10) Patent No.: US 6,779,580 B2
(45) Date of Patent: Aug. 24, 2004

(54) WOOD INTERIOR SCREEN FOR OUT-SWINGING WOOD WINDOW

(75) Inventors: Brad Woodward, Warroad, MN (US); Lenny Wong, Warroad, MN (US); Tim Stoll, Warroad, MN (US); Anthony Scott Head, Roosevelt, MN (US)

(73) Assignee: Marvin Lumber & Cedar Company, Warroad, MN (US)

( * ) Notice: Subject to any disclaimer, the term of this patent is extended or adjusted under 35 U.S.C. 154(b) by 23 days.

(21) Appl. No.: 10/348,632

(22) Filed: Jan. 20, 2003

(65) Prior Publication Data

US 2004/0140061 A1 Jul. 22, 2004

(51) Int. Cl.[7] ..... A47H 1/00

(52) U.S. Cl. ..... 160/92; 160/90; 160/91; 49/168

(58) Field of Search ..... 160/90, 91, 92, 160/96, 89; 49/62, 67, 141, 168, 169

(56) References Cited

U.S. PATENT DOCUMENTS

| | | | | |
|---|---|---|---|---|
| 1,184,208 A | | 5/1916 | Peter | |
| 1,201,885 A | | 10/1916 | Soule | |
| 1,256,838 A | | 2/1918 | Soule | |
| 1,604,054 A | | 10/1926 | Kuyper | |
| 1,671,827 A | | 5/1928 | Kempthorne | |
| 1,680,092 A | | 8/1928 | Dixson | |
| 1,721,641 A | | 7/1929 | Seibold | |
| 1,744,341 A | | 1/1930 | Spencer et al. | |
| 1,745,208 A | | 1/1930 | Dixson | |
| 1,805,403 A | | 5/1931 | Johnson | |
| 2,000,366 A | | 5/1935 | Victor | |
| 2,134,454 A | | 10/1938 | Nicholson | |
| 2,202,247 A | | 5/1940 | Green | |
| 2,208,889 A | | 7/1940 | Bliss | |
| 2,247,306 A | | 6/1941 | Partridge | |
| 2,247,634 A | | 7/1941 | Houston | |
| 2,286,899 A | | 6/1942 | Crescentini | |
| 2,320,268 A | | 5/1943 | Cramer | |
| 2,402,247 A | | 6/1946 | Green | |
| 2,502,665 A | | 4/1950 | O'Drago | |
| 2,541,971 A | | 2/1951 | Thies | |
| 2,699,206 A | | 1/1955 | Banner et al. | |
| 2,705,062 A | | 3/1955 | Bongiovanni | |
| 2,716,447 A | | 8/1955 | Adams et al. | |
| 2,724,155 A | | 11/1955 | Hindin | |
| 2,877,840 A | * | 3/1959 | Hurowitz et al. | 160/91 |
| 2,975,830 A | * | 3/1961 | McDonald | 160/92 |
| 4,392,330 A | * | 7/1983 | Buhr | 49/381 |
| 4,694,612 A | | 9/1987 | Pruden et al. | |
| 4,813,180 A | * | 3/1989 | Scalzi | 49/161 |
| 4,860,811 A | * | 8/1989 | Flakk | 160/92 |
| 4,944,118 A | | 7/1990 | Biro | |
| 4,945,679 A | * | 8/1990 | Aumercier | 49/342 |
| 5,486,553 A | | 1/1996 | Deaner et al. | |
| 5,491,940 A | | 2/1996 | Bruchu | |
| 5,539,027 A | | 7/1996 | Deaner et al. | |

(List continued on next page.)

FOREIGN PATENT DOCUMENTS

| | | | | |
|---|---|---|---|---|
| JP | 10222569 | * | 8/1998 | 160/92 X |

*Primary Examiner*—Bruce A. Lev
(74) *Attorney, Agent, or Firm*—Schwegman, Lundberg, Woessner & Kluth, P.A.

(57) ABSTRACT

A window system includes an out-swinging window having an exterior surface, and an interior surface. The viewable portions of the interior surface are made of a first material. The window system also includes a jamb. The out-swinging window is pivotally attached to the jamb. A screen assembly is removably mountable to the jamb on the interior surface of the out-swinging window. The screen assembly further includes a frame portion with a viewable portion made of the first material. In some embodiments, the window system further includes a finish strip positionable between the screen of the screen assembly and the frame of the screen assembly and a set of instructions regarding the window system.

24 Claims, 9 Drawing Sheets

U.S. PATENT DOCUMENTS 5,540,019 A 7/1996 Beske et al.
5,553,420 A 9/1996 Klimek
5,555,684 A 9/1996 Galowitz et al.
5,603,585 A 2/1997 Bruchu et al.
5,622,017 A 4/1997 Lynn et al.
5,657,579 A 8/1997 Bruchu et al.
5,666,773 A 9/1997 Librande et al.
5,687,519 A 11/1997 Bruchu
5,787,657 A 8/1998 Librande et al.
5,837,095 A 11/1998 Bruchu et al.
5,934,353 A 8/1999 Buhr ..... 160/269
6,108,997 A * 8/2000 Blais et al. ..... 52/656.7
6,109,328 A * 8/2000 Montana et al. ..... 160/92
6,123,135 A 9/2000 Mathews
6,161,605 A * 12/2000 Pena ..... 160/90
6,267,168 B1 7/2001 Davies et al.
6,405,781 B2 6/2002 Davies et al.
6,588,154 B1 * 7/2003 Miller et al. ..... 49/401
2001/0011579 A1 8/2001 Davies et al.

* cited by examiner

WOOD INTERIOR SCREEN FOR OUT-SWINGING WOOD WINDOW

TECHNICAL FIELD

The present invention relates to out-swinging windows. More particularly the present invention relates to an interior screen for an out-swinging window.

BACKGROUND

Windows can be sorted into two categories. There are windows having fixed sashes and windows with operable or movable sashes. The windows with movable sashes can be opened while the windows having fixed sashes can not be opened. The windows having operable sashes can be further categorized. Among the categories of operable or movable sash type windows are out-swinging windows. Out-swinging windows include hardware that moves the window and window sash outwardly from the window frame or window jambs as the window is being opened. In other words, the window and window sash swing out away from the exterior of the building in which they are mounted. Out-swinging windows include casement windows, french casement windows, awning windows and Jalousie windows.

Screens are placed on most windows to keep unwanted pests from entering through the window while the window is in an open position. In the past, screens have been positioned on the exterior of a window or on the interior of the window. Screens for out-swinging windows are generally placed inside of the sash. In other words, the screens are placed on the interior side of the out-swinging window. In the past, the screens include a mesh material stretched over a metal frame. Generally, the color of the metal frame of the screen and the screen material itself differs from the color of the interior surfaces of an out-swinging window and also differs from the wood finish material on the interior of the window. The metal frame of the screen and the screen can always be seen from the living space. In other words, if the window can be seen, so can the metal frame and screen. The fact that the metal frame of the screen is made of a different material and is a different color generally detracts from an aesthetically pleasing look when viewed from the interior or living space in which an out-swinging wood window is used.

In addition, the screen frame is generally made of thin metal which must be very carefully handled to prevent bowing or permanent deformation. The screen is removable so that the window can be more easily cleaned from the interior living space where the window is used. If care is not exercised during the removal and replacement of the screen, the metal frame can undergo permanent deformation. The screen and the metal frame look even less aesthetically appealing when bent, bowed or permanently deformed. In addition, the bending or bowing, can also cause the screen to lose the ability to keep out bugs or other pests that are bothersome to humans when inside the living space.

SUMMARY

A window system with an out-swinging wood window has an exterior surface, and an interior surface. The viewable portions of the interior surface are made of a first material. The window system also includes a jamb. The out-swinging window is pivotally attached to the head and sill. Operation hardware is connected to the out-swinging window and the jamb. The operation hardware moves the out-swinging window with respect to the jamb. A screen assembly is removably mountable to the jamb on the interior surface of the out-swinging window. The screen assembly further includes a frame portion with a viewable portion made of the first material. In some embodiments, the first material is wood. The frame of the screen assembly also includes a portion made from a second material. In some embodiments, the second material is metal, such as aluminum. The second material is substantially unseen at the interior surface of the window assembly. The portion made from the second material includes a slot adapted to receive and hold a spline. The portion made from the second material includes a first hook portion, a second hook portion, a channel, and a spline receiving slot. The screen assembly further comprises a corner key for attaching a first frame section to a second frame section. The first portion of the screen assembly includes a first groove for engaging a first hook portion and a second groove for engaging the second hook portion. In some embodiments, the window system further includes a finish strip positionable between the screen of the screen assembly and the frame of the screen assembly.

An interior mesh or cloth screen assembly for an out-swinging window includes a frame further having a first portion made from a first material, and a second portion made from a second material. A screen is affixed to the frame. In some embodiments, the second material is metal. The second portion further includes a first feature for attaching the first portion of the frame, and a second feature for attaching the first portion of the frame. The first portion of the frame has a first recess therein for receiving the first feature of the second portion of the frame, and the second portion of the frame has a second recess therein for receiving the second feature of the second portion of the frame. The second portion of the frame has a aperture therein. The interior screen assembly also includes a corner connecter. The corner connecter has a first leg and a second leg dimensioned to fit within the aperture of the second portion of the frame. The second portion of the frame has a slot therein. The interior screen assembly also includes a flexible spline. The edge of the screen and the flexible spline are positioned within the slot to affix the screen mesh or cloth to the frame. In some embodiments, the second portion of the frame snap fits with the first portion of the frame.

A window system includes an out-swinging window with an exterior surface, and an interior surface. The viewable portions of the interior surface are made of a first material. The window system also includes a jamb to which the out-swinging window pivotally attached. Operation hardware is connected to the out-swinging window and the jamb. The operation hardware moves the out-swinging window with respect to the jamb. The window system also includes a screen assembly removably mountable to the jamb on the interior surface of the out-swinging window. The screen assembly has a frame portion further with a first portion made from a first material, and a second portion made from a second material. The portion of the frame presented to the interior is made of the first material. The window system includes a finish strip adapted for positioning between the frame portion of the screen and a screen mesh or cloth material attached to the frame. In some embodiments, the window system also includes a set of instructions.

More specific features and advantages will become apparent with reference to the DETAILED DESCRIPTION, appended claims, and the accompanying drawing figures.

DETAILED DESCRIPTION

In the following Detailed Description, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
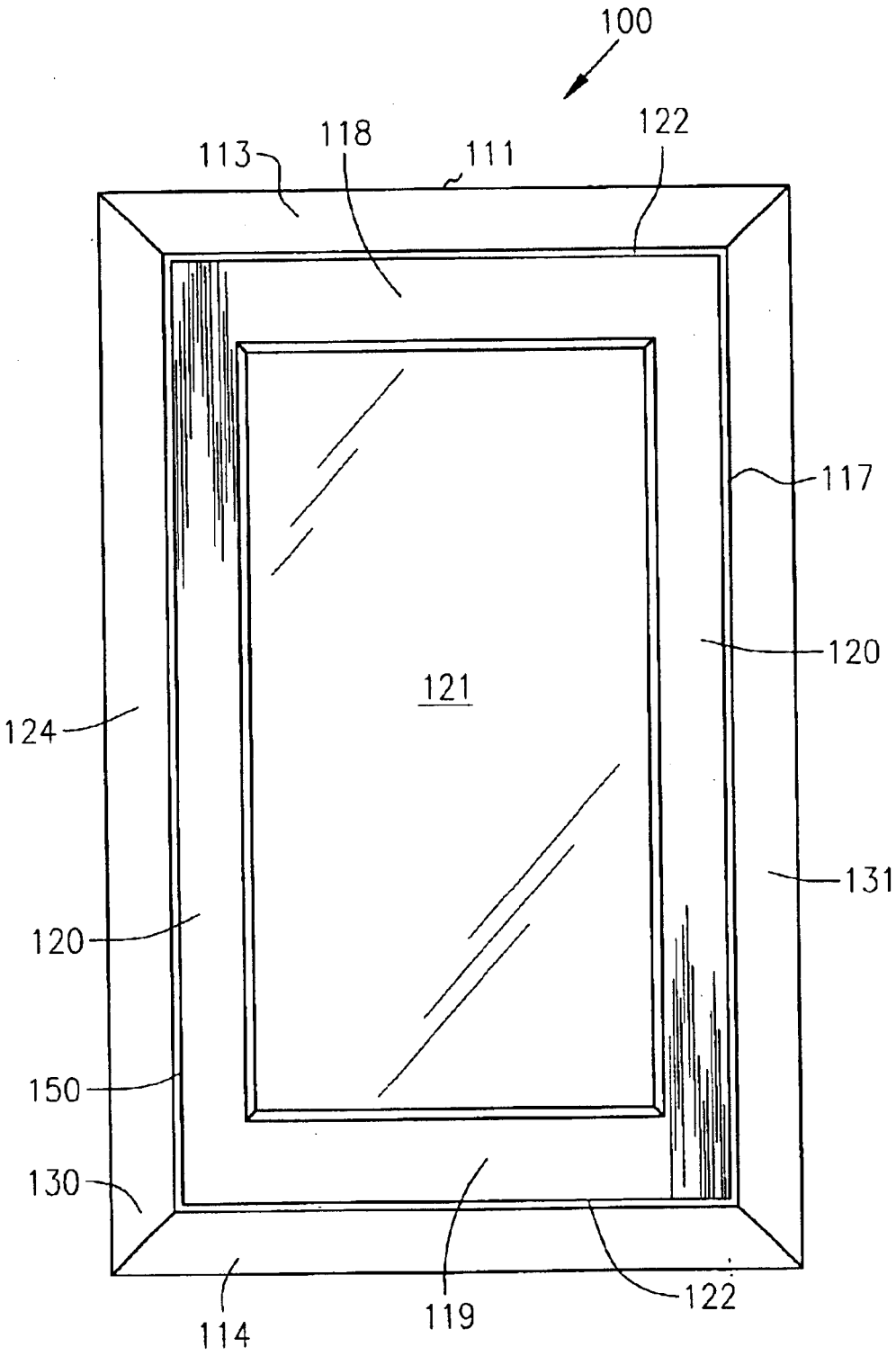
FIG. 1 is an elevational view of an exterior portion of a out-swinging window system of one embodiment.

FIG. 1 is an elevational view of an exterior portion 150 of an out-swinging window system 100 according to one embodiment. The out-swinging window system 100 shown is a casement window. A casement window is one type of out-swinging window system. Other out-swinging window systems include French casement windows, awning windows and Jalousie windows. The casement window units shown in FIG. 1 includes a rectangularly shaped window frame 111 including a vertical frame member 131, a vertical frame member 124, a horizontal upper frame member 113, and a horizontal lower frame member 114. The out-swinging window system 100 includes a casement window sash 117 which includes an upper horizontal member 118, a lower horizontal frame member 119, spaced apart vertical frame members 120 and a transparent glass panel 121. The casement sash 117 is provided with upper and lower track and hinge assemblies 122 which movably mount the case window sash 117 to the window frame 111. The horizontal lower frame member 114 is slanted outwardly, thereby forming a sill 130 on the exterior surface 150 of the casement window or out-swinging window unit 100. It should be noted that the frame members 113, 114, 131, and 124 are also referred to as jambs.

Figure 2:
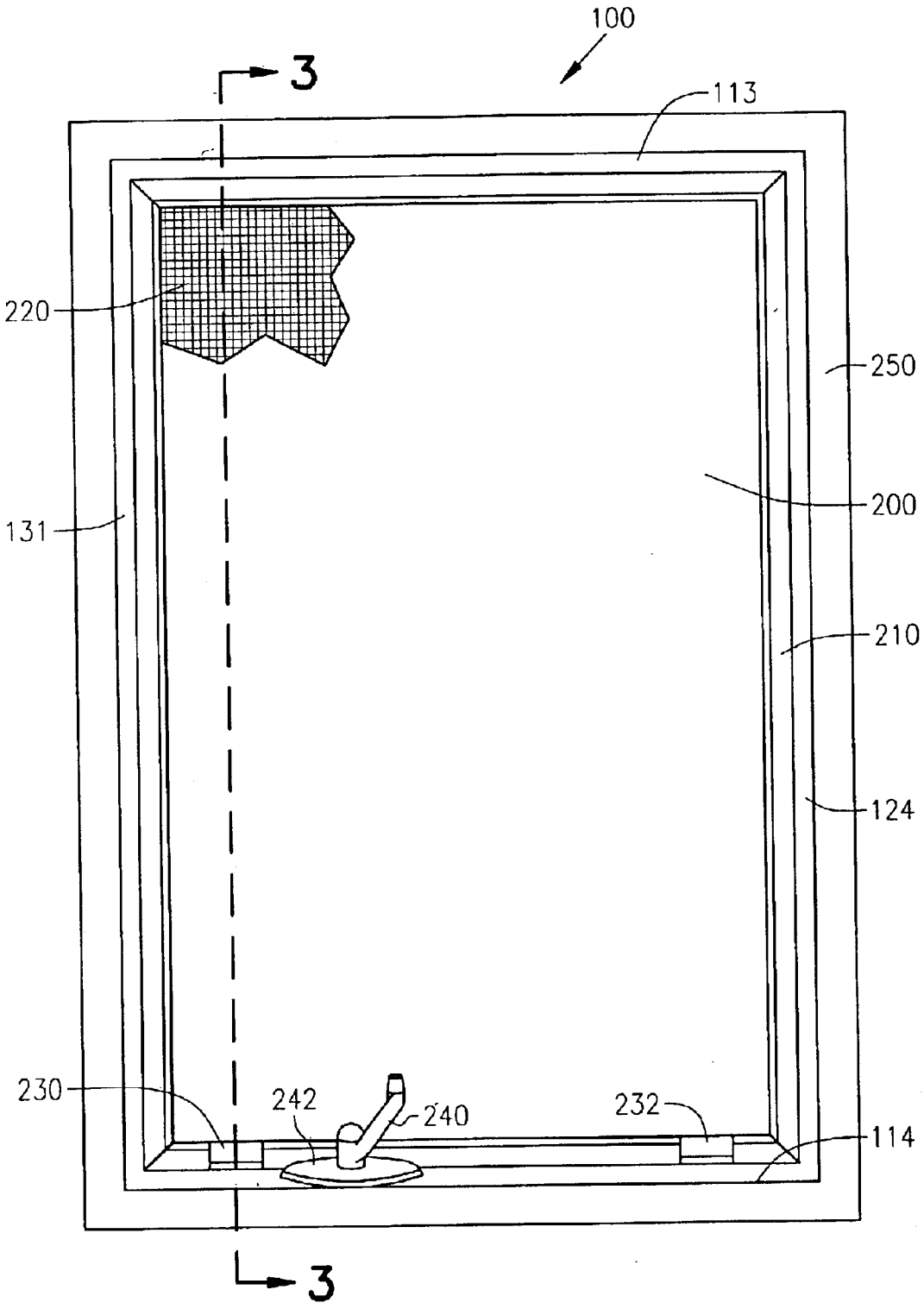
FIG. 2 is an elevational view of an interior portion of a out-swinging window system of one embodiment.

FIG. 2 is an elevational view of the interior portion of the out-swinging window system 100 according to one embodiment. The interior surface is designated by the reference numeral 250. The interior surface includes upper horizontal frame member or jamb 113, lower horizontal frame member or jamb 114, and vertical frame members or jambs 131, 124. A screen assembly 200 is shown positioned within the interior portion 250 of the frame elements or jambs 113, 114, 131, 124. The screen assembly 200 includes a frame 210. A screen 220 is stretched over the frame and attached to the frame 210. The frame also includes a first lift tab 230 and a second lift tab 232. Lift tabs 230 and 232 are used to remove the screen assembly 200 such as when the screen needs to be cleaned. It should be noted that the screen unit 200 is removably attached to the frame elements 113, 114, 131, 124.

Also shown on the interior surface 250 of the window system 100 is an operating hardware portion and housing 240, 242, respectively, which are associated with the operator hardware. In addition to the upper and lower track and hinge assemblies 122, the lower horizontal frame unit or jamb 114 is attached to the sash 119 (see FIG. 1) by the operator hardware. The operator hardware includes a series of linkages and sliders which are used to move the sash 118, 119, 120 with respect to the upper and lower horizontal frame unit 113, 114 respectively. In other words, the operator hardware, depicted in part by the housing 242 and the knurled nut (not shown) adapted to receive a handle 240, are used to move the window out or out-swing the window from the frame units 113, 114, 131, 124 (see FIG. 1).

Figure 3:
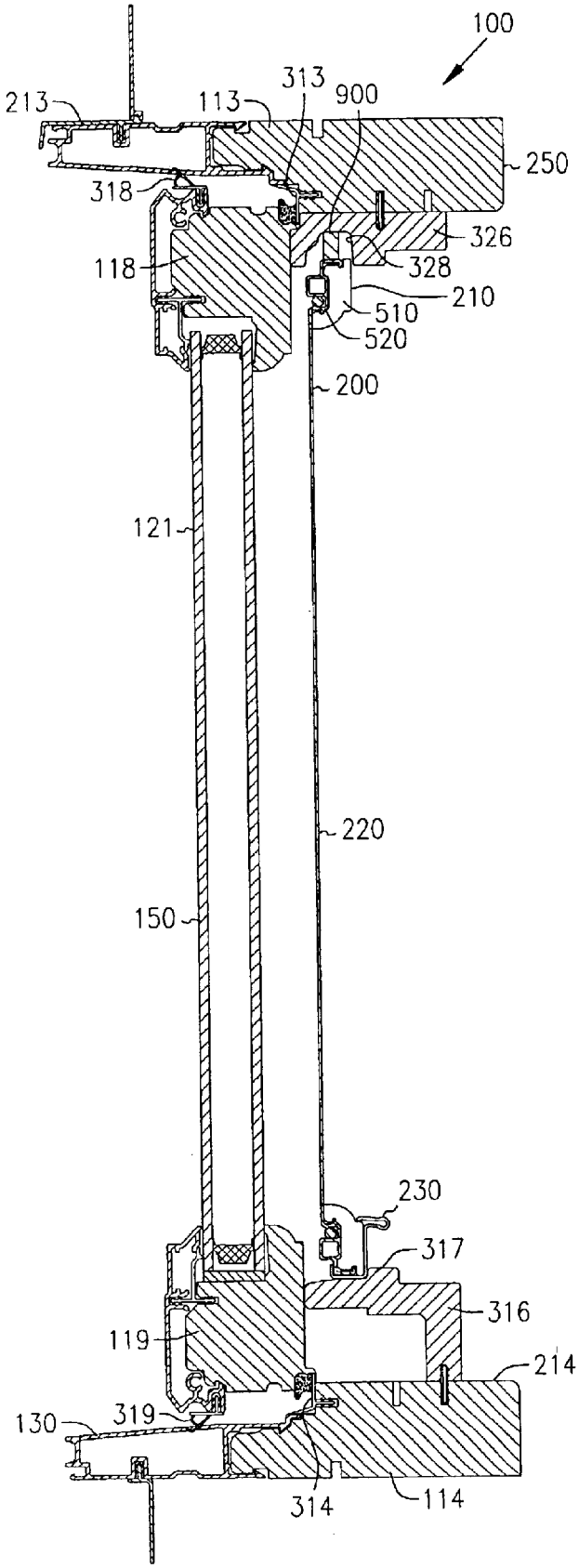
FIG. 3 is a cross-sectional view of the window system shown in FIG. 2 along line 3—3.

FIG. 3 is a cross-sectional view of the window system 100 shown in FIG. 2 along line 3—3. In this particular cross-sectional view, the vertical frame member 124 is not shown for the sake of clarity. As shown in FIG. 3, the window system 100 includes the upper horizontal frame jamb 113 and the lower horizontal frame member 114. The upper horizontal frame member 113 includes a weather seal or rain cap 213. The lower horizontal frame member or jamb 114 includes the exterior sill surface 130 as well as an interior sill surface 214. The window system 100 shows a lower horizontal sash unit 119 and the upper horizontal sash unit 118. Positioned within the sash is a transparent glass panel 121. The transparent glass panel 121 is a double pane, thermal pane type of glass unit in which the pane of glass is actually comprised of two panes of glass which are sealed. It should be noted that a transparent pane of glass can include a single pane of glass, a double pane of glass or triple pane of glass. As shown in FIG. 3, the window system is in a closed position where the sash 118, 119 is brought into engagement with a weather-strip 313 associated with the upper horizontal frame member and a weather-strip 314 associated with the lower horizontal frame member 114. When the sash 118, 119 is engaged with the weather-strip 313, 314, a seal is formed between the frame 113, 114 and the sash 118, 119. Additional seals 318, 319 are used to seal the portion of the sash 118, 119 from weather which would occur at the exterior surface 150 of the window system 100.

As shown in FIG. 3, the lower horizontal frame member 114 or jamb is provided with an essentially L-shaped wood cover 316. The L-shaped wood cover 316 attached to the lower horizontal frame member or jamb 114 can be thought of as an extension of the lower horizontal frame portion or jamb 114. The L-shaped wood cover 316 houses some of the hardware associated with operating the window system 100. The operating hardware is not shown for the sake of clarity. The L-shaped wood cover 316 includes a shoulder 317 that abuts the frame 210 of the screen assembly 200. Similarly, the upper vertical frame member 113 is provided with an additional head stop 326 that includes a groove 328 which receives the frame member 210 of the frame assembly 200.

As can be seen in this cross-sectional view, the frame 210 is actually comprised of a first portion 510 and a second portion 520. In some embodiments, the second portion 520 is comprised of a metal, such as aluminum. The first portion 510 of the frame 210 is formed of the same material or a similar material used on the interior 250 of the window system. For example, the first portion 510 is made of wood when the upper horizontal frame member 113 and the lower horizontal frame member 114, as well as portions 316 and 326, are also made of wood. As a result, substantially all of the interior portions of the window assembly 100 that can be viewed from the interior 250 of the interior side of the window are made of wood or a substantially similar material. This is aesthetically pleasing to the consumer and the user of the window. It should be noted that the lift tabs, such as the ones shown as 230 in FIG. 3, are generally metal clips which are only a portion of the frame 210 of the screen assembly 200.

Figure 4:
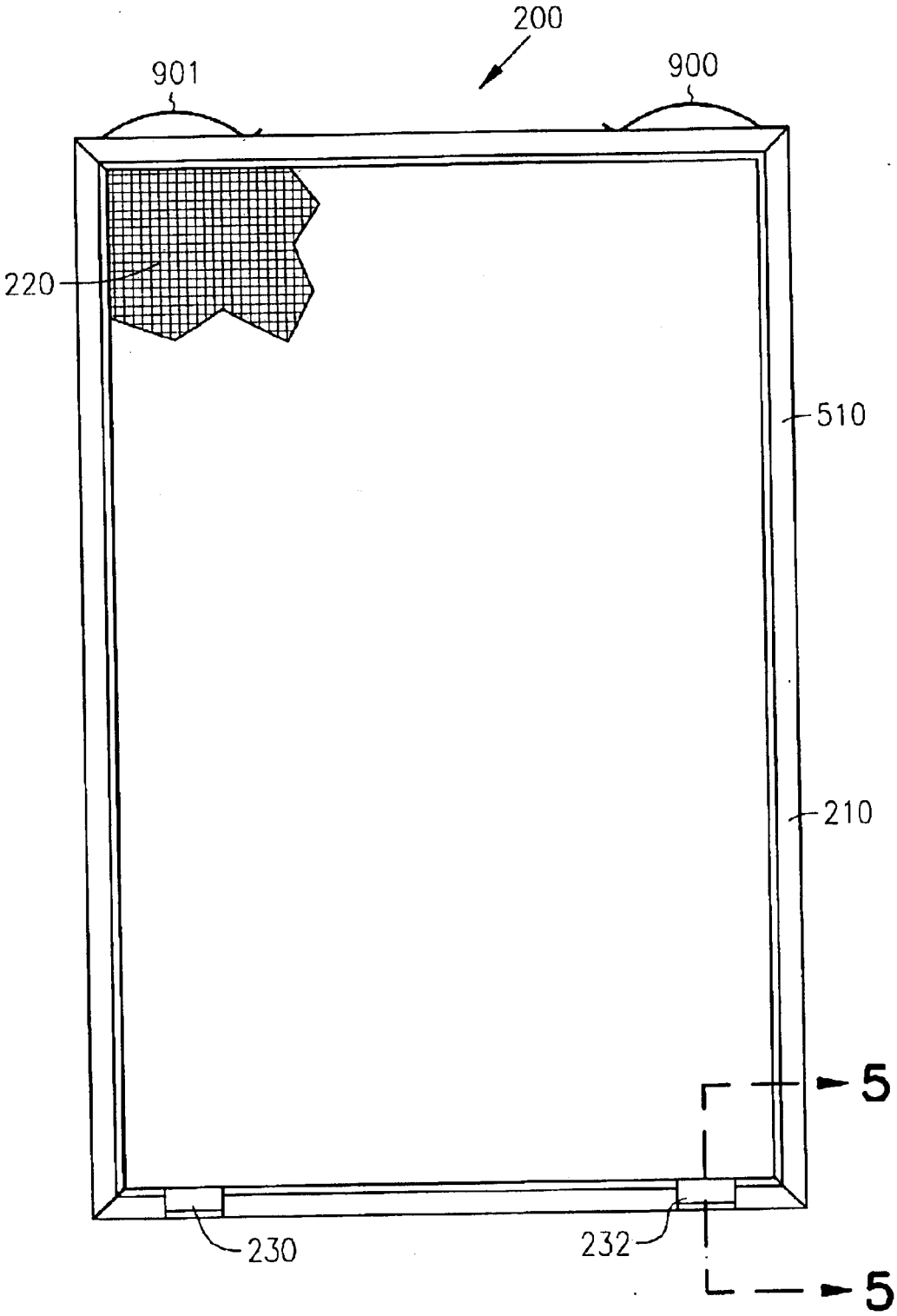
FIG. 4 is an elevational view of the screen assembly according to one embodiment.
Figure 5:
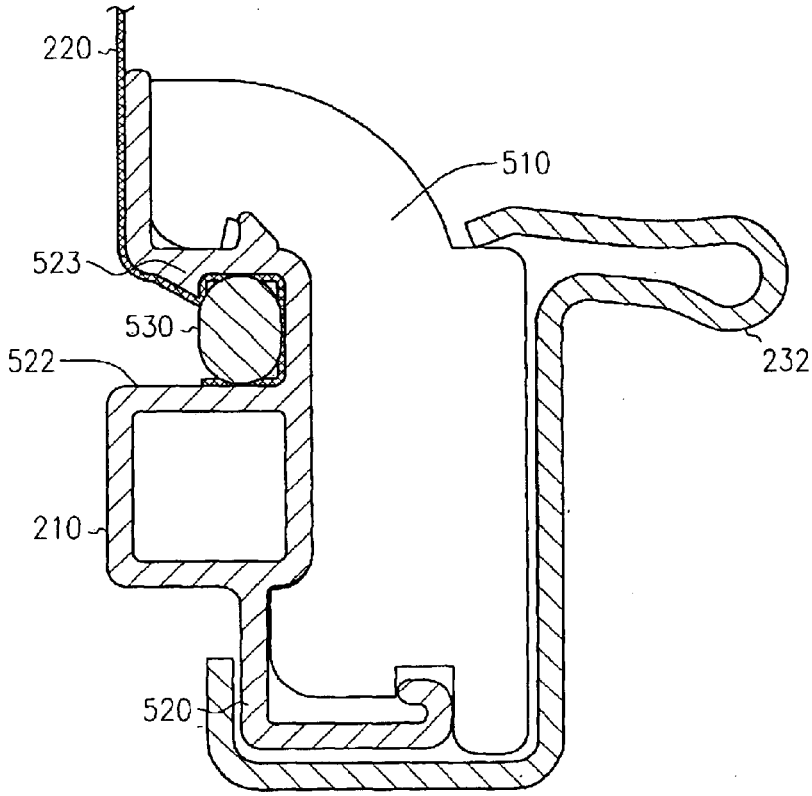
FIG. 5 is a cross-sectional view of the of the frame of the screen assembly shown in FIG. 4 along line 5—5, according to one embodiment.

FIG. 4 is an elevational view of a screen assembly 200 according to one embodiment of the invention FIG. 5 is a cross-sectional view of one portion of the frame 210 of the screen assembly 200, as shown in FIG. 4 along line 5—5 according to one embodiment. The screen assembly 200, and the frame 210, will now be discussed with respect to FIGS. 4 and 5. The screen assembly 200 includes the frame 210 and the screen 220. The frame 210 includes a first portion 510 and a second portion 520. The second portion 520 of the screen is behind the first portion 510 of the screen frame 210 when viewed from the interior portion 250 of the window assembly (see FIG. 3). The first portion 510 is made of a similar or the same material as the inside portion 250 of the window frame of the window assembly 100. The second portion 520 is made of a second material such as an aluminum extrusion. The second portion 520 includes a slot 522 therein. Also included is a spline 530. The spline 530 fits within the slot 522 within the second portion 520 of the frame 210 of the screen assembly. The spline 530 captures the outside edge of the screen 220. The spline 530 holds the screen or fixedly holds the screen 220 with respect to the frame 210 of the screen assembly. The screen 220 is shown in FIG. 5 and extends into the slot 522. The screen 220 is captured between the surface of the slot 522 and the spline 530. The slot 522 includes a capture member 523 which captures or holds the spline 530 in place within the slot 522.

Figure 6:
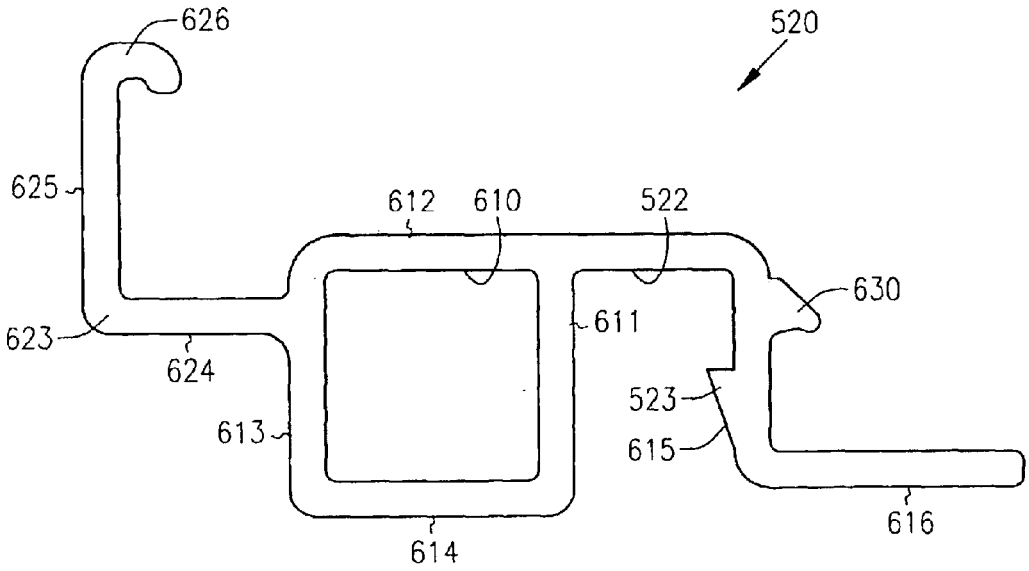
FIG. 6 is a cross-sectional view of the of metal portion (screen cap) of the frame of the screen assembly according to one embodiment.

Now turning to FIG. 6, the second portion 520 of the frame 210 of the screen assembly is further detailed. The second portion 520 is typically an aluminum extrusion or an extrusion of another metal having the cross-sectional shape shown in FIG. 6. As mentioned in FIG. 5, the second portion 520 of the frame 210 of the screen assembly 200 includes slot 522 having the capture element 523. The metallic extrusion also includes an aperture 610. The aperture 610 is substantially square and has sidewalls 611, 612, 613 and 614. Sidewall 611 has one surface which forms part of the aperture 610 and has another surface which forms a part of the slot 522. The aperture 610 is used to receive a corner connector, as will be discussed with respect to FIG. 11. Attached to sidewall 613 is an L-shaped member 623 having a first leg 624 and a second leg 625. The second leg 625 ends with a hook portion 626. The leg 625 and the hook portion 626 form a J-shaped hook feature. The J-shaped hook feature formed by leg 625 and end 626 is the first connecting feature of the extruded metal portion 520 of the screen frame 210. A second connecting feature 630 is positioned opposite the slot 522 of the extruded metal portion 520. The second connecting portion 630 is nose-shaped. The nose-shaped connecting feature 630 and the capture member 523 are part of sidewall 615 of the extruded metal portion or second portion 520 of the frame 210 of the screen assembly 200. Another wall portion 616 is connected to wall portion 615. The second portion or extruded metal portion is referred to as the screen cap 520 of the frame 210 of the screen assembly 200.

Figure 7:
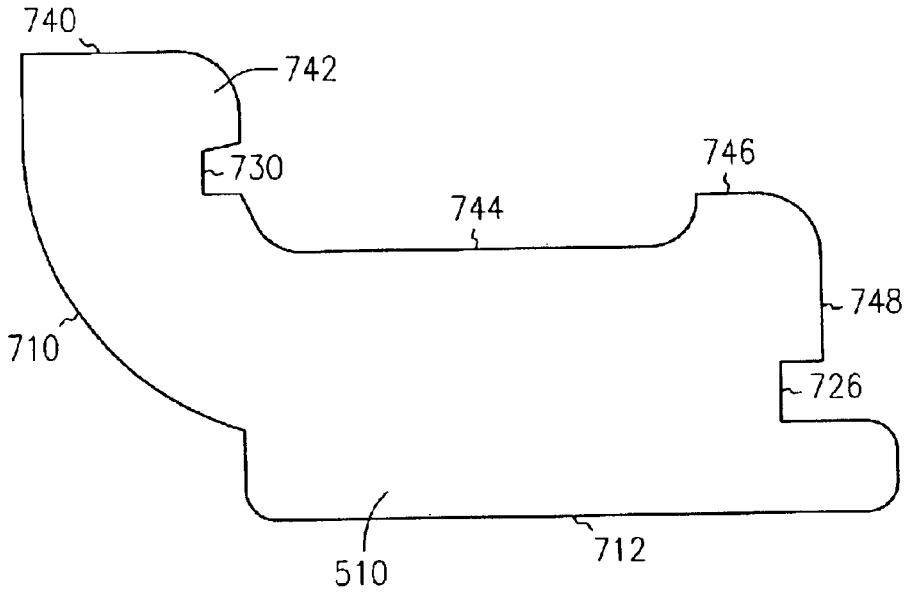
FIG. 7 is a cross-sectional view of the of wooden portion (screen surround) of the frame of the screen assembly according to one embodiment.

FIG. 7 is a cross-sectional view of the first portion 510 of the frame 210 of the screen assembly 200 according to an embodiment. The first portion 510 of the frame 210 of the screen assembly 200 is also known as the screen surround. The first portion 510 or screen surround includes a visible surface, depicted by reference numeral 710 and 712. The surfaces 710, 712 are those that are seen or viewable from the interior side 250 of the window system 100. Thus, the shapes of the surfaces 710, 712, which are curved and straight, respectively, can be modified to vary the aesthetic look of the screen frame 210. The screen surround or first portion 510 of the screen frame 210 also includes a surface which mates with the metal portion or screen cap or second portion 520 of the screen frame 210. The first portion 510 includes a first groove 726 and a second groove 730. First groove 726 accepts or receives the J-shaped connecting feature depicted by legs 625 and J-shaped ends 626 of the screen cap or second portion 520. The second groove 730 receives the connecting feature 630 of the screen cap or second portion 520 of the screen frame 210. It should be noted that the screen cap or second portion 520 snaps onto the first portion 510 or wooden portion or screen surround 510 of the frame 210 of the screen assembly 200. In summary, the connecting features 625, 626, 630 in conjunction with recess surface 744 hold parts together.

Since the first portion 510 of the screen frame 210 is made of wood, it is possible that the first portion 510 will warp. The second portion 520, which is made of an extruded metal, will straighten the wood and also strengthen the screen surround so that it is a both rugged and naturally looking product. The first portion 510 or the screen surround also includes surfaces 740, 742, 744, 746 and 748. The surfaces 740, 742, 744, 746 and 748, as well as the grooves 726 and 730, are adapted to receive and essentially conform to corresponding surfaces on the screen cap or extruded metal portion or second portion of the screen frame 210. Thus, surfaces 740, 742, 744, 746, 748, and groove 726 and 730 are very tightly controlled in terms of their dimensions so that a snap-fit is produced and so that a surface conforming to the second portion 520 of the screen frame is produced. In essence, surfaces 740, 742, 744, 746, 748 and grooves 726, 730 are dimensioned to form a mating surface which will allow snap-fit engagement of the second portion 520 of the screen frame 210.

Figure 8:
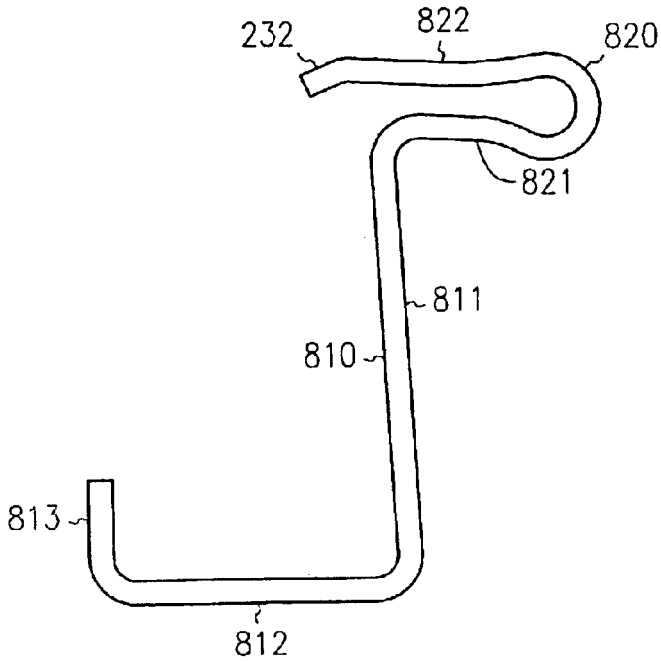
FIG. 8 is a cross-sectional view of a screen lift tab which is attached to the frame of the screen assembly according to one embodiment.

FIG. 8 is a cross-sectional view of a screen lift tab, such as 230, 232, which is attached to the frame 210 of the screen assembly 200 according to one embodiment. The lift tab 232 includes, in one option, a J-shaped portion 810 which includes legs 811, 812 and 813. The lift tab 232 also includes a U-shaped portion 820 which includes leg 821 and elongated leg 822. The U-shaped portion 820 serves as the portion used to actually apply a force to lift the screen assembly 210 from capture member 317, 328 within the portions 316, 326 associated with the lower horizontal frame element 114 and the upper horizontal frame element 113, respectively. As shown in FIG. 5, the J-shaped portion or leg 810 of the lift tab 232 encloses a portion of the screen cap or second portion 520 and the screen surround or first portion 510 of the screen frame 210. The U-shaped portion 820 is attached to the J-shaped portion 810. The elongated leg 822 rests upon or contacts a lip on the surface 710 of the first portion 510 or screen surround of the screen frame 210. The distance between legs 822 and 812 of the screen lift tab are set so that the U-shaped portion 820 acts as a small spring. The portion of the frame between legs 822 and 812 is held in compression by the legs 822 and 812.

Figure 9:
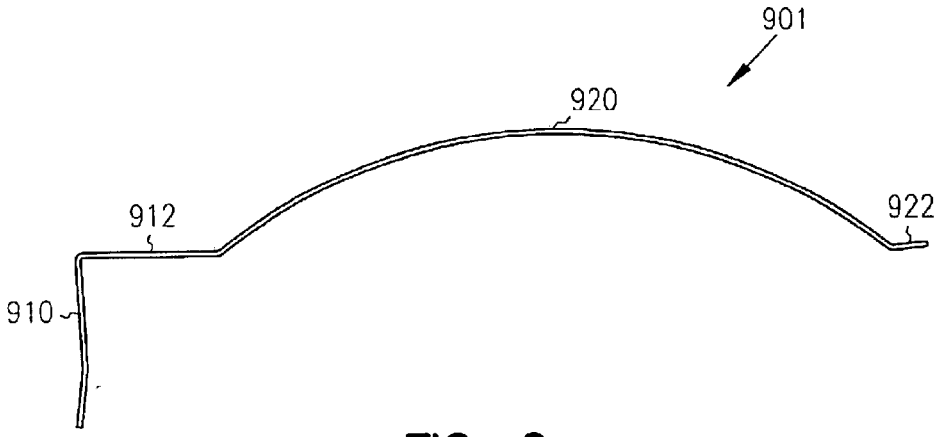
FIG. 9 is a cross-sectional view of a bow spring attached to the frame of the screen assembly according to one embodiment.

FIG. 9 is a cross-sectional view of a bow spring 901 attached to the upper end of the frame 210 of the screen assembly 200 (see FIG. 4). Bow spring 901 includes a first leg 910 and a second leg 912 which are at approximately 90° with respect to one another. In fact, the leg 910 and the leg 912 are at an angle slightly less than 90° so that a spring force is applied to the corner of the frame 210 to which the bow spring 901 is attached. The bow spring also includes a leaf-spring portion 920. At the end of the leaf-spring portion 920 is a skid tab 922. In operation, the lift tabs 230, 232 are used to deflect the bow spring or bow springs 901, 900 (see FIG. 4) against the top upper head stop 326. The skid tab 922 allows the bow spring to flex while the skid tab rides along the top surface of the frame 210. The lift tabs are actually lifted over stop 317. This causes the bow springs to deflect downwardly. The screen can then be put into place behind the stop feature 317 and leaf-spring portion 920 of the bow spring 901 relaxes to an installed position. The bow spring engages the groove 328 in element 326 of the upper horizontal frame member 113, thereby keeping the screen assembly 200 in place within the window frame.

Figure 10A:
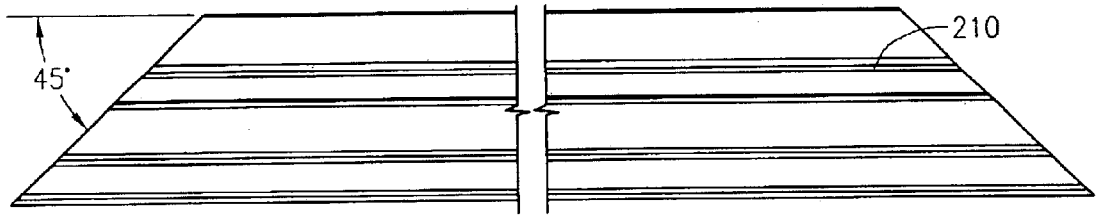
FIG. 10A is a view of the of a portion of the frame of the screen assembly according to one embodiment.
Figure 10B:
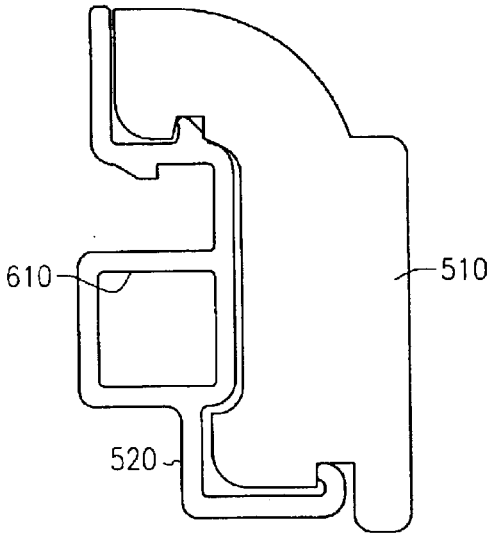
FIG. 10B is a cross-sectional view of the portion of the frame of the screen assembly according to one embodiment.

FIG. 10A is a view of a portion of the frame 210 of the screen assembly 200 according to one embodiment. FIG. 10B is a cross-sectional view of the portion of the frame 210 of the screen assembly 200 according to an embodiment. With respect to FIGS. 10A and 10B, construction of the frame 210 will be discussed. The frame 210 is comprised of four separate sides. One side is shown in FIG. 10A. The side shown in FIG. 10A will have an overall dimension L. Each side will be cut off at approximately 45° so that when one side is mated with another side, a 90° angle will be formed with respect to the screen frame. Therefore, in constructing a side, generally the first portion 510 or the screen surround is attached to the screen cap or second portion 520 of the screen frame 210. Next, 45° cuts are made at the overall length of each side. The 45° angle cut allows for a mitered corner on the screen 210. In view of the finished leg of the frame 210, as shown in FIG. 10B, with the first frame portion 510 engaging the second frame portion 520 and cut off at a 45° angle.

Figure 11:
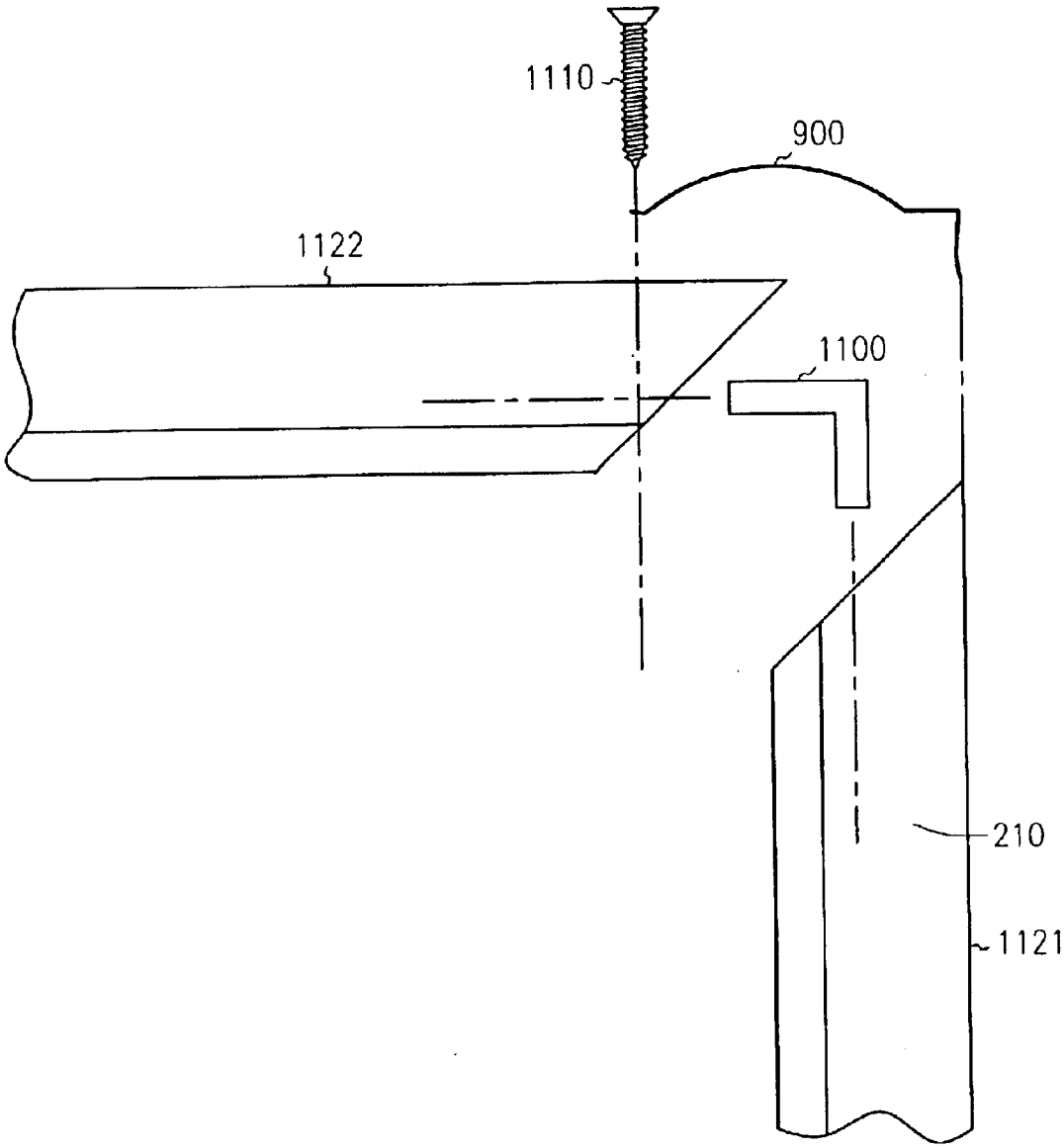
FIG. 11 is a top view of a corner assembly associated with the frame of the screen assembly according to one embodiment.

FIG. 11 is a top view of the corner assembly associated with a frame 210 of a screen assembly 200 according to one embodiment. As shown in FIG. 11, the frame 210 is comprised of a first leg 1121 and a second leg 1122. The frame legs 1121, 1122 are similar to those shown in FIG. 10A. In FIG. 11, only one end of each leg 1121, 1122 of the frame 210 is shown. The frame 210 includes a corner key 1100. The corner key 1100 is a connector having two substantially equal length legs formed at approximately or substantially a 90° angle. The corner key 1100 has a profile which fits within the opening 610 or aperture 610 of the second portion 520 of the frame 210 (see FIG. 6). To assemble the frame, a corner connector is placed into the aperture 610 in one of the legs 1121 or 1122. Next, the corner connector is placed into the aperture 610 associated with the other leg 1122 or 1121. The two legs 1121 and 1122 can then be brought together to form a mitered substantially right angle or 90° corner. A fastener 1110 is then placed into the frame 1122 so that it passes through frame member 1122 and into frame member 1121. The fastener 1110 passes through the first portion 510 of the legs 1122 and 1121 of the frame 210. The fastener 1110 holds the legs 1121, 1122 of the frame 210 together. Assembly of the corner can be further completed by attaching the bow spring 900 when the corner is an upper corner of the frame 210. The lower corners of the frame 210 are complete after the fastener 1110 is passed through one leg and into another of the legs of the frame 210.

Figure 12:
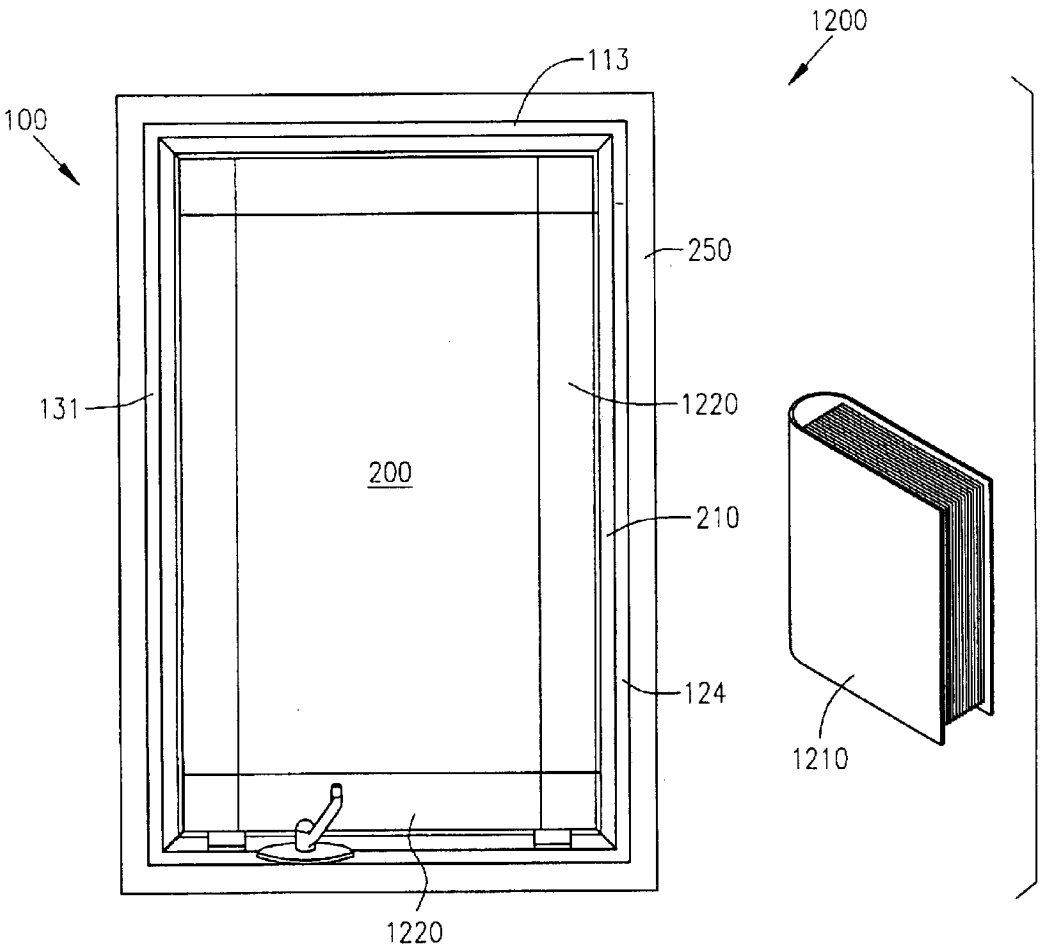
FIG. 12 is a view of a window system kit.

FIG. 12 is a view of a window system kit 1200. The window system kit includes a window system 100, a manual of instruction 1210, as well as a finish strip 1220. The manual of instruction 1210 includes instructions on installing and operating the window system 100. The window system kit 1200 also includes a finish strip 1220. The finish strip 1220 is made of a suitably thin material so that an edge of the finish strip 1220 fits between the screen 220 and the frame 210 of the screen assembly 200. The finish strip 1220 allows the end user such as a contractor or home owner to apply a finish to the first part 510 of the frame 210 of the screen assembly 200 while protecting the screen 220 from paint, stain, varnish or the like. Advantageously, the finish strip 1220 is shipped along with the window system kit 1200 or along with the window system 100 so that the window system 100 is shipped from the factory in a ready-to-finish condition. It should be noted that the out-swinging window shown in the window system kit 1200 is a casement window but that the invention is equally applicable to any other type of out-swinging window including awning windows, French casement windows, or a Jalousie window which includes a two-part screen assembly 200 on the interior portion 250 of an out-swinging window.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims and their equivalents.

What is claimed is:

1. A window system comprising:

an out-swinging window further comprising:

an exterior surface;

an interior surface, viewable portions of the interior surface made of a first material;

a jamb, the out-swinging window pivotally attached to the jamb;

operation hardware operably connected to the out-swinging window;

a screen assembly removably mounted to the jamb on the interior surface of the out-swinging window, the screen assembly further comprising a frame portion with a viewable portion made of the first material; and the frame portion of the screen assembly is further comprised of a portion made from at least a second material.

2. The window system of claim 1 wherein the first material is wood.

3. The window system of claim 1 wherein the second material is metal.

4. The window system of claim 1 wherein the second material is substantially unseen at the interior surface of the window assembly.

5. The window system of claim 1 wherein the second material is aluminum.

6. The window system of claim 1 wherein the second material is metal, and wherein the portion made from the second material includes a slot adapted to receive and hold a spline.

7. The window system of claim 1 wherein the portion made from the second material is metal, the portion made from the second material including:

a first hook portion;

a second hook portion;

a channel; and a spline receiving slot.

8. The window system of claim 7 wherein the screen assembly further comprises a corner key for attaching a first frame section to a second frame section.

9. The window system of claim 7 wherein the first portion of the screen assembly further comprises a first groove for engaging a first hook portion and a second groove for engaging the second hook portion.

10. The window system of claim 1 further comprising a finish strip, the finish strip positionable between the screen of the screen assembly and the frame of the screen assembly.

11. An interior screen assembly for an out-swinging window comprising:

a screen affixed to a frame;

the frame further including:

a first portion made from a first material, and a second portion made from a second material;

the second portion further comprising:

a first feature for attaching the first portion of the frame; and a second feature for attaching the first portion of the frame.

12. The interior screen assembly for an out-swinging window of claim 11 wherein the first portion of the frame has a first recess therein for receiving the first feature of the second portion of the frame, and the second portion of the frame has a second recess therein for receiving the second feature of the second portion of the frame.

13. The interior screen assembly for an out-swinging window of claim 12 wherein the second portion of the frame snap fits with the first portion of the frame.

14. The interior screen assembly for an out-swinging window of claim 11 wherein the second portion of the frame has an aperture therein.

15. The interior screen assembly for an out-swinging window of claim 14 further comprising a corner connecter, the corner connecter having a first leg and a second leg dimensioned to fit within the aperture of the second portion of the frame.

16. The interior screen assembly for an out-swinging window of claim 14 wherein the second portion of the frame has a slot therein, the interior screen assembly further comprising a flexible spline, the edge of the screen and the flexible spline positioned within the slot to affix the screen to the frame.

17. The interior screen assembly of claim 11, wherein at least a portion of the first material is wood.

18. The interior screen assembly of claim 11, wherein at least a portion of the second material is metal.

19. A window system comprising:

an out-swinging window further comprising:

an exterior surface;

an interior surface, viewable portions of the interior surface made of a first material;

a jamb, the out-swinging window pivotally attached to the jamb;

operation hardware connected to the out-swinging window and the jamb, the operation hardware for moving the out-swinging window with respect to the jamb;

a screen assembly removably mounted to the jamb on the interior surface of the out-swinging window, the screen assembly further comprising a frame portion, the frame portion comprising:

a screen portion a first frame portion made of the first material;

a second frame portion made of a metal, the second screen portion having a slot therein for receiving a spline and an edge of the screen portion, the second frame portion further including:

a substantially square-shaped aperture having a first sidewall and a second sidewall, the aperture having a third sidewall spaced away from the second sidewalls, the third sidewall and the second sidewall associated with the slot for receiving a spline;

a L-shaped member attached to a first sidewall, the L-shaped member having a J-shaped hook feature;

a capture member positioned on the third sidewall and within the slot for holding the spline within the slot;

a nose-shaped connecting feature attached on the third sidewall opposite the capture member, wherein the nose-shaped connecting feature and the J-shaped hook feature connect to mating features in the first frame member.

20. The window system of claim 19 wherein the J-shaped hook feature and the nose-shaped connecting feature mate snap-fit with corresponding features of the first frame member.

21. The window system of claim 19 further comprising a lift tab that fits over the first portion of the screen frame and the second portion of the screen frame.

22. The window system of claim 21 further comprising a bow spring attached to an upper portion of the screen frame.

23. The window system of claim 19 further comprising a U-shaped lift tab wherein the legs of the U-shaped portion fit over the first portion of the screen frame and the second portion of the screen frame.

24. The window system of claim 23 further comprising a bow spring attached to an upper portion of the screen frame.

* * * * *